United States Patent [19]

Walters et al.

[11] Patent Number: 4,928,410

[45] Date of Patent: May 29, 1990

[54] REVERSIBLE CLAM SHELL BUCKET

[76] Inventors: Darrell L. Walters, 2441 Cornelius Ave., Rio Oso, Calif. 95674; Steven D. Larsen, 2165 California St., Sutter, Calif. 95982

[21] Appl. No.: 63,226

[22] Filed: Jun. 17, 1987

[51] Int. Cl.[5] ..... E02F 3/76

[52] U.S. Cl. ..... 37/117.5; 37/195; 172/254; 414/704; 414/739

[58] Field of Search ..... 37/117.5, 118, DIG. 3, 37/DIG. 12, 195; 172/136, 250, 251, 254; 414/704, 739, 722

[56] References Cited

U.S. PATENT DOCUMENTS

| | | | |
|---|---|---|---|
| 2,935,802 | 5/1960 | Wolfe et al. | 37/117.5 |
| 3,581,924 | 6/1971 | Marz | 414/704 |
| 3,738,030 | 6/1973 | Olinger | 37/117.5 |
| 3,854,608 | 12/1974 | Arnold | 37/117.5 X |
| 3,975,844 | 8/1976 | Olson | 37/117.5 |
| 4,372,063 | 2/1983 | Work | 37/117.5 X |
| 4,519,739 | 5/1985 | Risch | 414/704 X |
| 4,595,240 | 6/1986 | Pettersson | 37/117.5 X |

OTHER PUBLICATIONS

Brochure-Gannon, ©1987, 1 pg., "Multi Purpose Bucket".

*Primary Examiner*—Edgar S. Burr
*Assistant Examiner*—Moshe I. Cohen
*Attorney, Agent, or Firm*—Bernhard Kreten

[57] ABSTRACT

A material handling apparatus connected to a prime mover having first and second jaws, the first jaw connected and configured to approximate a grading blade for a bulldozer, and the second jaw connected to the first jaw in one of two orientations, 180 degrees apart and about vertical axis. The jaws also have open and closed positions, defining four extreme positions. The combined first and second jaws define either a bucket, or when the second jaw is extended away from the grader blade a clam shell type bucket, or a pincer type grappler.

18 Claims, 2 Drawing Sheets

REVERSIBLE CLAM SHELL BUCKET

FIELD OF THE INVENTION

The following invention relates generally to clam shell type buckets formed from two jaws and commonly used for picking up material. One of the jaws, according to the instant invention, is reversible by rotating it 180 degrees about a vertical axis. When so configured, the two jaws can be utilized for grading, scraping, general earth moving and excavation. Thus, the function of several different earthworking intrumentalities are combined.

DESCRIPTION OF THE PRIOR ART

Material handling equipment, particularly as it relates to construction, farming and other earth engineering endeavors is not inexpensive. It is a common sight to see a plurality of diverse earth engineering tools mounted on different bull dozers, loaders, caterpillars or other prime movers. Alternatively, it is common to have the earth engineering implements stationed on a jobsite for selective use by the prime mover operator depending upon the conditions associated with the material to be handled.

By having several different earth engineering implements either standing by or deployed on several prime movers, inefficiencies exist because these implements are relatively expensive, installation is time consuming, and when plural machines are used there is an associated increase in cost. When a job is not so large as to warrant several prime movers, an operator may either forego changing implements, or particularly, if no other implement is available, perform the task at hand inefficiently.

Accordingly, it would be desireable to provide a single material working implement which can conform to, and efficiently handle, diverse types of work.

The following patents reflect the state of the art of which applicant is aware insofar as they appear to be germain to the patent process. Moreover, these patents are cited in direct response to applicant's acknowledged duty to disclose relevant prior art:

2,935,802—Wolfe, et al;
3,738,030—Olinger;
3,854,608—Arnold;
4,595,240—Petersson;
Brochure—Gannon "Multi-Purpose" Buckets copyright 1987.

None of these prior art citations either singularly or in any conceivable combination teach or render obvious the nexus of the instant invention. More particularly, none provide a reversible "clam shell" type bucket wherein one of two jaws can be expeditiously reoriented 180 degrees about a vertical axis so as to accomodate diverse uses and needs.

For example, Wolfe et al is representative of the known technique of having a plurality of different implements readily attachable as needed. The remaining citations each provide a bucket having first and second articulated portions in order to have the bucket perform two jobs.

SUMMARY OF THE INVENTION

By way of contrast, the instant invention is distiguished over the known prior art in that an instrumentality is provided formed from first and second jaws uniquely configured so that a one jaw can be rotated 180 degrees about a vertical axis which can assume an "open" or "closed" position. Thus, there are two orientations for one of the two jaws and two extreme positions for that one jaw so as to provide at least four operative positions when the said one jaw is at a position extremity. By virtue of the configurations associated with the instant invention, a grader, a bucket, a clam shell type pincer, and a surface scarifier, (debris or brush cleaning position) will be effected.

OBJECTS OF THE INVENTION

The primary object of this invention is to provide a new and useful implement for material handling.

More specifically, this invention contemplates as an objective the provision of an improved earth working apparatus.

It is a further object of this invention to provide a device as characterized above which is relatively economical when compared with prior art techniques for providing similar functions, is durable in construction, and lends itself to rapid reorientation with a minimal down time so as to provide diverse uses for a single piece of equipment.

More particularly, it is an object of the present invention to provide an instrumentality which is formed from two jaws and is used to handle material in which one of the two jaws is configured to allow itself to be rotated about a vertical axis into one of two positions, 180 degress apart. At least four useful embodiments will be provided thereby; when the one reversible jaw is in a first orientation, the two jaws can either be opened or closed with respect to one another defining two positions, and when the reversible jaw is in a second orientation the jaws can be also opened or closed to provide two further positions. Thus, different work surfaces and conditions will be processed by truly different implements.

DESCRIPTION OF THE DRAWING FIGURES

BRIEF DESCRIPTION OF THE PREFERRED EMBODIMENT

Figure 1:
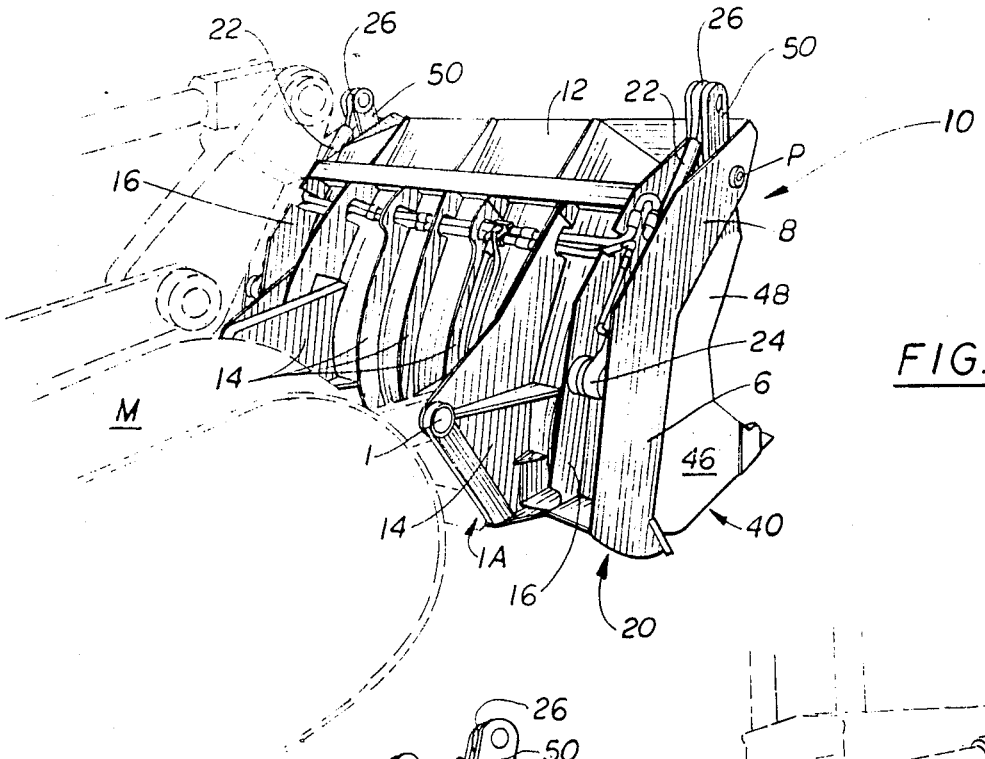
FIG. 1 is a rear perspective view of the apparatus according to the present invention in one configuration.

Referring to the drawings now, wherein like reference numerals refer to like parts throughout the various drawing figures, reference numeral 10 is directed to the clam shell type bucket according to the present invention.

In its essence, the bucket 10 is attached to a prime mover M which, as shown schematically, is a caterpillar type tractor.

An essential concept of the instant invention is shown in FIGS. 3, 4 and 8, 9. A first jaw 20 is fixed to the prime mover M and a second jaw 40 is fixed to the first jaw 20 at two different locations. Two different orientations are shown in FIGS. 3, 4 and FIGS. 8, 9 respectively. In addition, the second jaw can either be in a closed first position (FIGS. 3, 9) or in an open second position (FIGS. 4, 8) thereby providing at least four operative positions for material handling and earth working. The features by which the reversible clam shell type bucket 10 are made operative will now be explored.

Connections 1, 1A connect the first jaw 20 to the prime mover M in a manner well known in the art. In essence, pivotal connections exist which are enabled by hydraulic means (not shown) carried on the prime mover M to allow motion of the first jaw 20 about the connections 1, 1A so that jaw 20 can assume multiple positions. This is a fairly well known feature common to most earth working machines.

The specific configuration of the first jaw 20, however, facilitates rapid connection with a second jaw 40 for purposes to be assigned hereinafter. The first jaw 20 will now be explored.

With reference to FIGS. 1, 2, 5, 6 and 7, the first jaw 20 includes a first wall face 2 which curves away from the prime mover M and a second wall face 12 which curves towards and addresses the prime mover M. A bottom portion of wall 2, 12 supports a scraper wear plate 4 having a leading edge 34 (FIGS. 3, 4, 8, 9) for purposes to be assigned. The wall 2, 12 also includes side walls having a lower portion 6 and an upper portion 8 angulated to conform to the arcuate surface of wall 2, 12 to provide strength along its side edges.

The rear back wall 12, facing the prime mover M, includes a plurality of gussets 14 which facilitate attachment to the prime mover M (for example at pivot 1 and 1A) and also rigidify the back wall for the substantial work which much be done with this earth working equipment.

Spaced inboard of side walls 6 and 8, and emanating from the wall face 12, a further support wall 16 is provided so that a hydraulic cylinder 22 is nested along each outboard edge of the first jaw, carried between the support wall 16 and side walls 6, 8. The cylinder 22 is pivoted at a lower most portion 24 which is fixed to the wall face 12 and has an upwardly extending end 26 connected to the second jaw 40 as will be described.

In addition, the wall face 2 (FIG. 5) includes support walls 28 at each upper corner which, in combination with the side wall upper portion 8, serves as a channel way that supports the second jaw 40. The support walls 16, 28 can be integrally formed, passing through wall faces 2, 12.

More particularly, the second jaw 40 (FIGS. 1, 2, 5, 6, 7) includes a bottom plate 44, 45, 54, 58 having a top surface 44, bottom surface 54 and ribs 53, which support a plurality of tines 42 from one edge thereof. Since tines 42 are optional, if removed, wear plate 56 has a leading edge that extends forwardly to the extent that the tines would have. The bottom plate is supported by means of a lower side wall 46 and an upper side wall 48 on both side edges of the bottom plate. The side walls 46, 48 extend upwardly to free ends 50 which (FIGS. 1 and 2) connect to the hydraulic cylinder 22 by means of the cylinder upper pivot 26.

Figure 5:
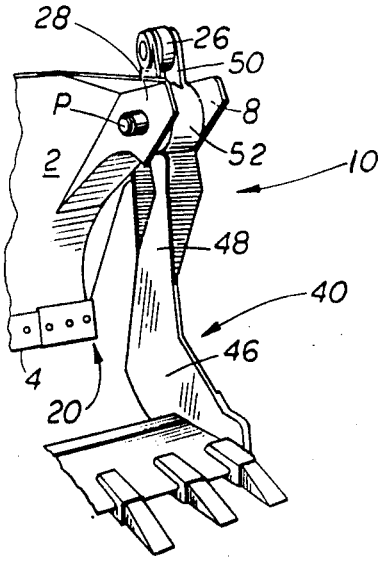
FIG. 5 is a perspective view of a portion of that which is shown in FIGS. 1 through 4.

Note in FIG. 5 that the transition between the side wall portion 48 and the free end 50 has interposed therebetween a rounded boss 52 which is girded by the support wall 28 and the upper side wall 8 and is secured thereto by a pivot pin P passing therethrough.

Figure 2:
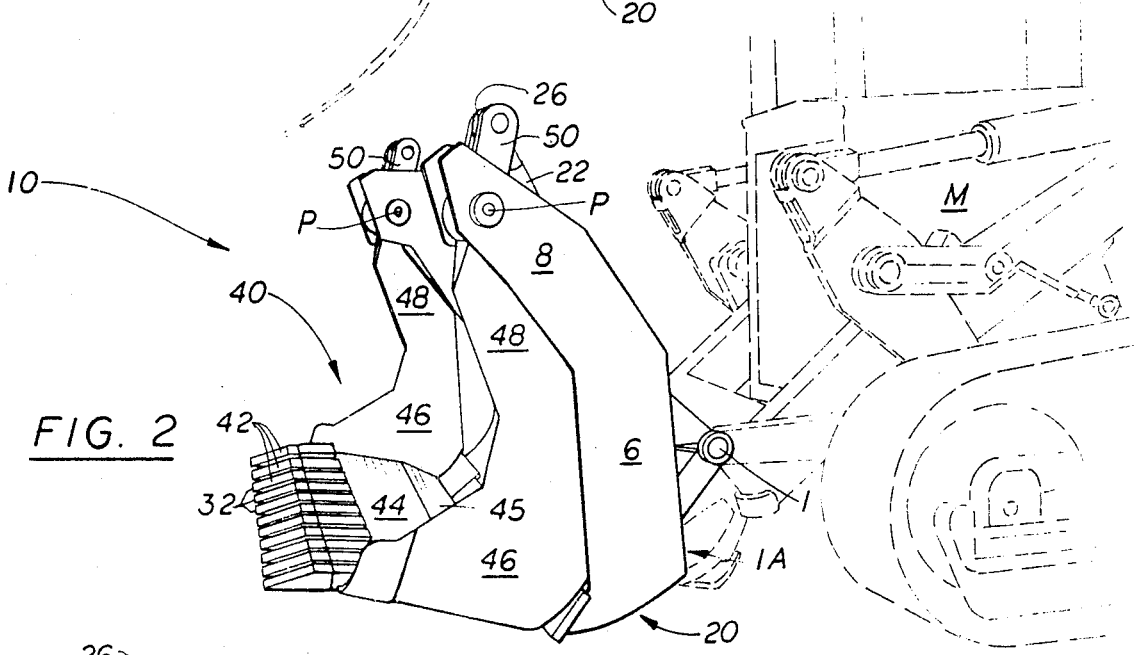
FIG. 2 is a second, front perspective view of that which is shown in FIG. 1.
Figure 3:
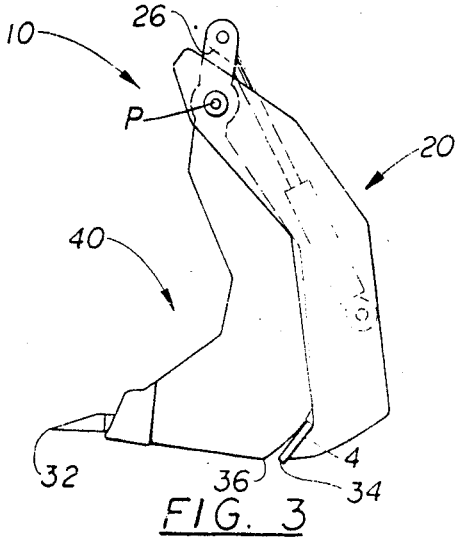
FIG. 3 shows the embodiments of FIGS. 1 and 2 in a first closed position.
Figure 4:
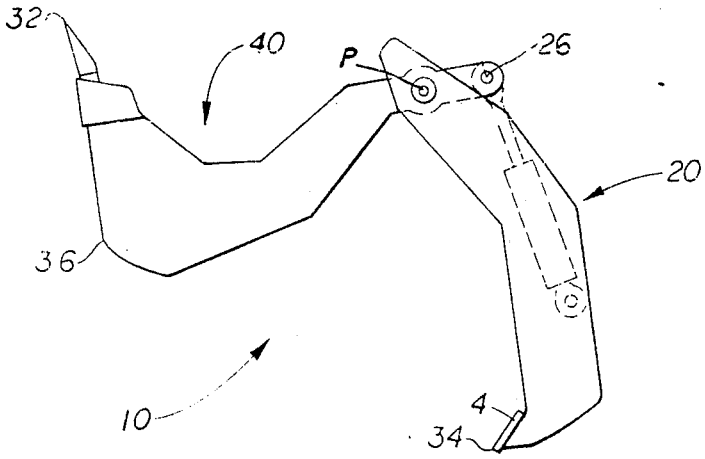
FIG. 4 shows a second open position compared to that which is shown in FIG. 3.

With respect to FIG. 2, note that the first jaw 20 and its lower side wall 6 parallels somewhat the upwardly extending side wall 46 of the second jaw 40, and that the upwardly and forwardly declinated top upper portion 8 of the first jaw 20 parallels the upper portion 48 of the second jaw 40. When the two jaws 20, 40 are oriented such as shown in FIG. 2, a bucket has substantially greater depth than the bucket shown by FIG. 7 (with the second jaw in an upward position). Thus, a greater payload of material can be carried.

Figure 6:
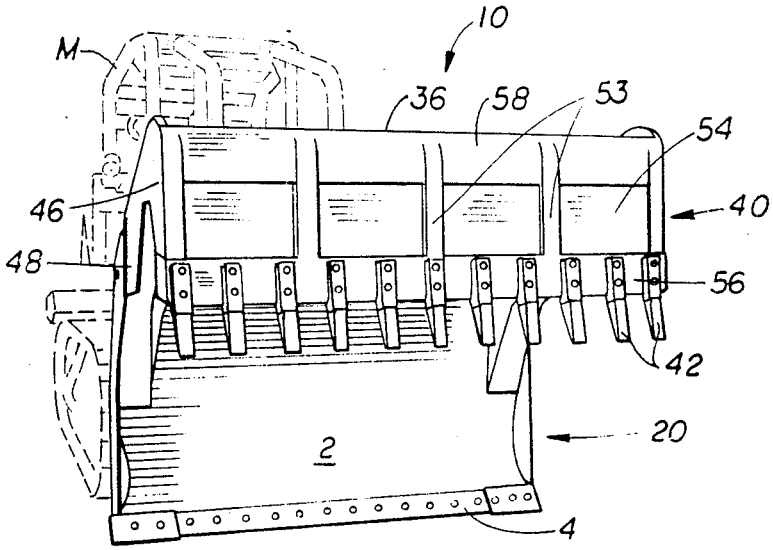
FIG. 6 is a perspective view of the apparatus according to the present invention with one of the jaws in a reversed mode, 180 degrees from that which is shown in FIG. 4.

With respect to the bottom plate of jaw 40, note that a trailing edge 45 is configured to abut against the wall 2. FIG. 6 shows a side of jaw 40, opposite from FIG. 2. The wall 58 has a trailing edge 36. The side walls 46, 48 and the plate 44, 58 generally define the second jaw 40 and can generally be regarded as having a substantially U shaped configuration. The bottom wall 58 as it extends toward the tines 42 includes a plurality of ribs 53.

Attention now is specifically made to FIGS. 3, 4, 8, and 9. Shown schematically is the pivot point P, the first jaw 20 with its edge 34 leading the scraper plate 4, and the second jaw 40 with its a tine tip 32 and trailing edge 36. The relationship of these components will now be discussed. For optimal effect, it is desireable that the tine tip 32 abuts against or is remote from the scraper plate edge 34 in open and closed first positions of FIGS. 8, 9. The trailing edge 36 is to contact or be removed from the scraper edge 34 when the second jaw 40 is in its open and closed second positions.

One way to do so would be to make the distance from the pivot point P to the tine tip 32, the scraper plate edge 34 and the trailing edge 36 all the same length. That is to say, distance P-32=P-34=P-36. This assures mating registry when the jaw 40 is rotated 180 degrees from the two orientations shown in FIGS. 3 and 4, and FIGS. 8 and 9. Note however, if distance P-32 does not equal P-36, the device can still be made optimal by having a second pivot point P′ placed elsewhere (higher up) on the upper side wall 8. See FIG. 9. In this event, one of the two pivots will be utilized so that edge 34 will always be contacted by second jaw 40. distance 26-14 32, and 26-36 are equal.

Figure 7:
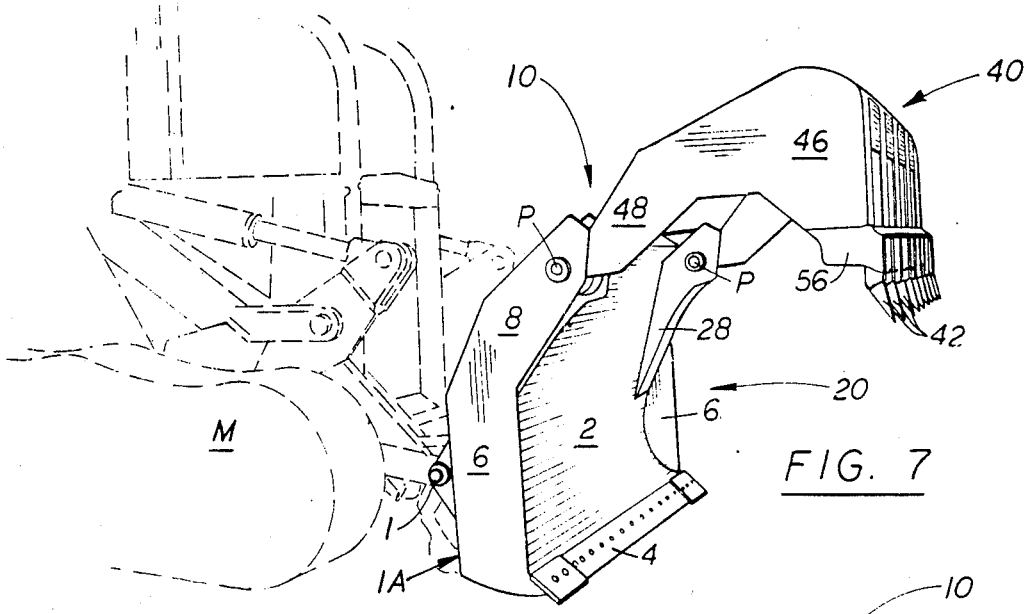
FIG. 7 is a different perspective of the view shown in FIG. 6.
Figure 8:
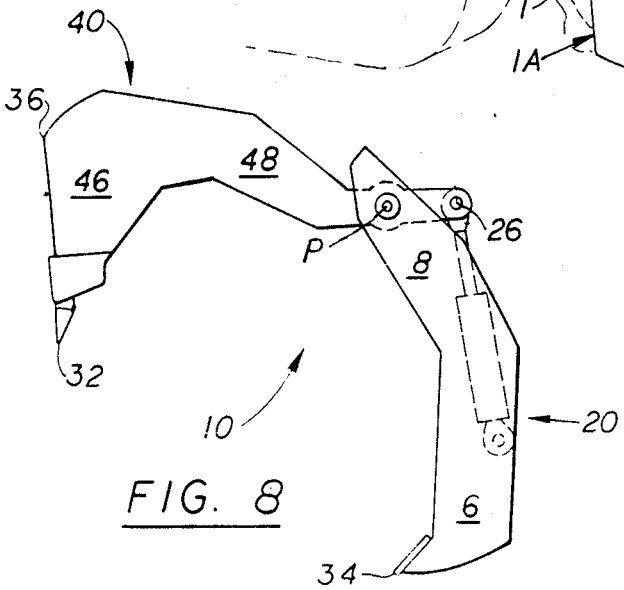
FIG. 8 is a side view of that which is shown in FIGS. 6 and 7 in a first open position.
Figure 9:
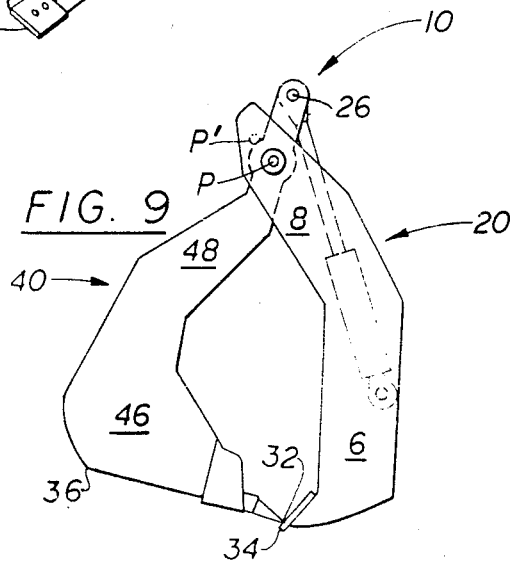
FIG. 9 shows a second closed position from that which is shown in FIG. 8.

In use and operation, the jaws can be shown in the extreme positions of FIGS. 2 and 7 or any position in between. Moreover, having thus described the invention it should be apparent that numerous structural modifications and adaptations may be resorted to without departing from the scope and fair meaning of this invention as delineated hereinabove and a defined hereinbelow in the claims.

I claim:

1. A reversible clam shell bucket comprising:

first and second jaws defining said bucket pivoted together at an upper extremity thereof, said first jaw attached to a prime mover, said second jaw further attached to said first jaw by means of a hydraulic cylinder, said second jaw having a lower leading edge with tines and a lower trailing edge both of which are equally distant from said pivotal connection with said first jaw, whereby rotation of said second jaw 180 degrees about a vertical axis will align either said leading edge tines or trailing edge against a bottom most portion of said first jaw.

2. The combination of claim 1 wherein said second jaw is of substantially U shaped configuration and includes a bottom plate, upwardly extending side walls emanating from side edges of said bottom plate terminating in free ends which are attached to said hydraulic cylinder connecting said first and second jaws.

3. The combination of claim 2 wherein said first jaw includes a back wall and side walls extending outwardly toward said second jaw, said side walls contoured and angulated to parallel said side walls of said second jaw.

4. The combination of claim 3 wherein a support wall is placed on said first jaw slightly inboard from said side walls and extending adjacent an area of pivotal connection of said second jaw and said first jaw, said side wall of said second jaw interposed between said support wall and side wall of said first jaw to serve as a guide.

5. The combination of claim 4 wherein a boss is provided along the area of pivotal connection between said first and second jaws.

6. The combination of claim 5 wherein said first jaw includes two support walls placed inboard said hydraulic cylinder and parallel to each said side wall of said first jaw, said hydraulic cylinder placed on a back face of said first jaw wall remote from said second jaw and protected by a channel defined by said support wall, a portion of said back wall and said side wall.

7. A material working tool used by operative connection to a prime mover comprising:

a first jaw having a one wall with a rear face connected to the prime mover and a wall front face directed away therefrom, a second jaw having a leading and a trailing edge, one of said edges being a tined edge and being removeably connected to said first jaw so as to assume one of two orientations and one of four extreme positions, a first orientation having two extreme positions wherein said second jaw has one tined edge which is turned toward said first jaw defining a clam-shell type bucket, and a second orientation having two extreme positions wherein said tined edge is turned away from said first jaw defining a grader-scarifier; said first and second jaws being connected at an upper extremity thereof by a pivot means, the distance between said pivot means and said leading and trailing edges of said second jaw being of equal distance.

8. The combination of claim 7 wherein each said orientation has two said extreme positions, a first position wherein said second jaw is proximate to said first jaw defining either a closed clam-shell bucket or a grader having operatively oriented earth engaging tines and, a second position wherein said second jaw is remote therefrom.

9. The combination of claim 8 wherein removable fastening means connects said first and second jaws and includes said pivot at an upward extremety connecting said first and second jaw, and a hydraulic cylinder connected between a lower portion of said first jaw and an upper portion of said second jaw.

10. The combination of claim 10 wherein the distance between a lowermost edge of said first jaw and said pivot equals the distance of the pivot to said leading and trailing edge of said second jaw.

11. In an earth working machine comprising:

a first jaw operatively connected to a prime mover defining the earth working machine having a scraper plate carried on a lower surface of a wall defining said first jaw, and side walls connected to marginal side portions of said first jaw wall extending forwardly, away from the prime mover and having an upwardly extending and forwardly declinated contour to complement the contour of said first jaw wall;

wherein a second jaw is operatively connected to said first jaw and includes a bottom plate having a leading edge including a plurality of tines extending outwardly therefrom, a trailing edge on said bottom plate, and upwardly extending side walls supported on lateral edges of said bottom plate and having a contour which parallels said side walls of said first jaw the outer surfaces of said sidewalls of said second jaw being spaced so that said second jaw fits within and fills the space between the inner surfaces of said sidewalls of said first jaw.

12. The combination of claim 13 wherein said second jaw includes an axis of rotation which is substantially vertical and equi-distantly disposed between said upwardly extending side walls, whereby rotation of said second jaw by 180 degrees about said vertical axis will allow either said tines or said trailing edge to address..

13. The combination of claim 12 wherein said second jaw is connected at four pivot points to said first jaw, a first two of said pivot points connecting top portions of first and second jaw side walls, and a second set of pivot points extending between a hydraulic cylinder disposed on a portion of said first jaw remote from said second jaw and connecting to said second jaw above said first jaw.

14. The combination of claim 11 wherein said second jaw is reconnected to said first jaw such that said tines face toward said first jaw to about against said first jaw scraper plate to form a clam shell type bucket.

15. A material working tool used by operative connection to a prime mover comprising:

a first jaw having a one side connected to the prime mover and a second side facing away therefrom, a second jaw removeably connected to said first jaw so as to assume one of two orientations, a first orientation wherein said second jaw has one tined edge which is turned toward said first jaw, and a second orientation wherein said tined edge is turned away from said first jaw, wherein each said orientation has two extreme positions, a first position wherein said second jaw is proximate to said first jaw, a second position wherein said second jaw is remote therefrom, wherein removable fastening means connects said first and second jaws and includes a pivot at an upward extremity connecting said first and second jaw, and a hydrualic cylinder connected between a lower portion of said first jaw and an upper portion of said second jaw, wherein said distance between said pivot and a leading and trailing edge of said second jaw are of equal distance, wherein the distance between a lowermost edge of said first jaw and said pivot equals the distance of the pivot to said leading and trailing edge of said second jaw.

16. A material working tool used by operative connection to a prime mover comprising:

a first jaw having a one side connected to the prime mover and a second side facing away therefrom, a second jaw removeably connected to said first jaw so as to assume one of two orientations, a first orientation wherein said second jaw has one tined edge which is turned toward said first jaw, and a second orientation wherein said tined edge is turned away from said first jaw, wherein the distance between a lowermost leading edge of said first jaw and a pivot connection between said first and second jaw equals the distance of the pivot to said second jaw's leading and trailing edges.

17. A clam shell bucket which converts from a pincer-type grasping, bucket orientation to a grader-scarifier orientation, comprising, in combination:

a first jaw connected to a prime mover at a rear wall of said first jaw, said first jaw having one working edge, a second jaw consisting of a single element having two working edges, a pair of pivot points connecting said first and second jaws which allow the jaws to open and close about said pivot pair such that said working edge, of said first jaw is in abutting contact one working edge of said second jaw when said jaws are closed, an extensible cylinder connecting said first and second jaws to open and close said jaws, means for removing said second jaw from its connection with said first jaw and reversing and reconnecting to said first jaw such that said working edge of said first jaw abuts against the other working edge of said second jaw.

18. A method for grading, scarifying, picking up and grappling material with a reversible, two-jaw tool including the steps of:

forming a first jaw with a wall having a front surface, a back surface and a lower working edge and attaching the first jaw to a prime mover at the back surface, forming a second jaw consisting of a single element with a bottom wall having two working edges both of which parallel the working edge of the first jaw, attaching the second jaw to the first jaw with pivots such that the working edge of the first jaw tangentially abuts against one working edge of the second jaw and the jaws pivot open and closed, attaching an extensible arm between the first and second jaws and driving the jaws between open and closed positions for doing work, disconnecting both the extensible arm and the pivots to dissociate the first and second jaws, reorienting the second jaw so that the other working edge abuts against the first jaw working edge, reconnecting the extensible arm and pivots to reunite the first and second jaws, allowing the jaws to open and close and do work.

* * * * *